United States Patent [19]

Stratton

[11] Patent Number: 4,490,873

[45] Date of Patent: Jan. 1, 1985

[54] FLOATING-BRUSH ASSEMBLY FOR USE WITH FLOOR-SCRUBBING AND POLISHING MACHINES

[76] Inventor: Harry M. Stratton, 16119 Francisquito, La Puente, Calif. 91744

[21] Appl. No.: 544,798

[22] Filed: Oct. 24, 1983

[51] Int. Cl.[3] ..... A47L 11/16

[52] U.S. Cl. ..... 15/49 R; 15/320

[58] Field of Search ..... 15/49 R, 49 RB, 49 C, 15/50 R, 50 A, 50 C, 51, 87, 98, 320, 385; 51/176, 177

[56] References Cited

U.S. PATENT DOCUMENTS 1,870,232 8/1932 Brim ..... 15/49 R 3,866,541 2/1975 O'Connor et al. ..... 15/50 R

*Primary Examiner*—Edward L. Roberts

*Attorney, Agent, or Firm*—Francis X. LoJacono

[57] ABSTRACT

This invention is directed to a free-floating-brush assembly for use in combination with scrubbing and polishing machines employed for cleaning and buffing hard-surface floors in large areas such as found in supermarkets, schools, hospitals, etc. The assembly includes a housing having a pair of floor brushes mounted therein and driven individually by battery-powered magnetic motors. The assembly is freely suspended in front of the machine by means of a joystick mechanism which allows for raising or lowering the housing assembly. A swivel device having a connecting pin is mounted and is pivotally connected to a crank arm member which forms part of the joystick mechanism. The assembly is angularly disposed and held in place by a pair of spaced spring members that further allow the housing assembly to not only rotate about the swivel device, but to freely adjust to any uneven floor surface.

6 Claims, 4 Drawing Figures

FLOATING-BRUSH ASSEMBLY FOR USE WITH FLOOR-SCRUBBING AND POLISHING MACHINES

BACKGROUND OF THE INVENTION

1. Field of the Invention

This invention relates generally to an automatic floor-scrubbing and polishing machine, and more particularly to a floating-brush assembly that is mounted thereto.

2. Description of the Prior Art

Various problems and difficulties are being encountered in providing suitable means for cleaning, scrubbing and waxing large floor areas, such as in grocery and department stores, hospitals, office buildings, etc.

There are numerous and varied arrangements of cleaning machines presently in use for scrubbing and buffing large floor areas, particularly in buildings where floors are covered with plastic or composition materials, and where there is very heavy foot traffic as well as vehicle traffic, such as grocery carts, portable machines, etc.

In those establishments where food products are stored and the loading of fresh produce takes place throughout the day, as in grocery stores, it is necessary to wash the open areas and aisles between the stacked shelves at least once a week but preferably twice a week, and to wax the floors at least once a week. Thus, it can be seen that because of the constant stacking and handling of the various foodstuffs and staples, resulting in frequent breaking and spilling of contents, it is essential that such floors be properly maintained on a continuous basis.

At present, there are several types of automatic scrubbing and polishing machines available. The trade names of some of these units are "Tornado", "Kent" and "Multi-Clean". These machines generally employ one or two motors that drive a brush or a pair of juxtaposed brushes; and they include a vacuum system, a spray system, a squeegee, and in most case a drive motor for the movement of the entire machine. Commonly, these machines also include two tanks—one to dispense a solution for cleaning, and the other to recover the used solution through a vacuum system. Most automatic scrubbers are self-contained units that are primarily operated by batteries having 24 or 36 volt systems. The intent of the automatic scrubber is to put cleaning solution onto any hard-floor surface from one of the two tanks, the solution being discharged through or adjacent the brush or brushes, and then spread and agitated with the brushes mounted at the front of the machine. As the machine passes over the scrubbed area with the cleaning solution disposed thereon, the squeegee attached to the rear of the machine collects the used solution, thus allowing the solution to be sucked up through a hose running from the other tank by means of a vacuum motor attached thereto. Hence, the used solution is picked up from the floor and deposited in a recovery tank.

However, problems still exist in providing a suitable floor-scrubbing mechanism that will effectively operate under various adverse conditions, such as uneven floor surfaces, and reduce the hours of labor required. Thus, with the combination of the above-mentioned automatic-type cleaning machines and the hereinafter described invention, further reduction in time, cost and labor can be accomplished.

SUMMARY AND OBJECTS OF THE INVENTION

The present invention has for an important object to provide a new and useful floating-brush assembly for scrubbing and polishing machines which is mounted to the front of a machine and is angularly disposed to its width, whereby the brushes are positioned to overlap each other so as to prevent streaking.

Another object of the invention is to provide a floating-brush assembly that is free-floating and self-adjusting for uneven floors, whereby the brushes make overall contact with the floor.

Still another object of the present invention is to provide a free-floating brush assembly that can be used in any confined area through which the machine is capable of passing, the assembly being arranged to rotate about a vertical axis as well as pivot along a horizontal axis.

It is a further object of the invention to provide a free-floating-brush assembly that is adaptable for use with most known scrubber machines.

A further object of the invention is to provide a free-floating-brush assembly that includes two brushes supported under the assembly housing—each brush being individually driven by a motor, the brush assembly being supported by an adjustable bracket arm, the bracket arm being pivotally connected to a ball-swivel device mounted to the top of the assembly housing, and the assembly being held at an angular position with respect to the width of the machine by a pair of biasing springs.

A still further object of the invention is to provide a brush assembly of this character that has relatively few operating parts, and that would be easy to service and maintain.

It is still a further object of the invention to provide a device of this character that is relatively inexpensive to manufacture, and is simple yet rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Novel features and advantages of the present invention in addition to those mentioned above will become apparent to those skilled in the art from a reading of the following detailed description in conjunction with the accompanying drawings, which are for illustrative purposes only, wherein.

DETAILED DESCRIPTION OF THE INVENTION

Figure 1:
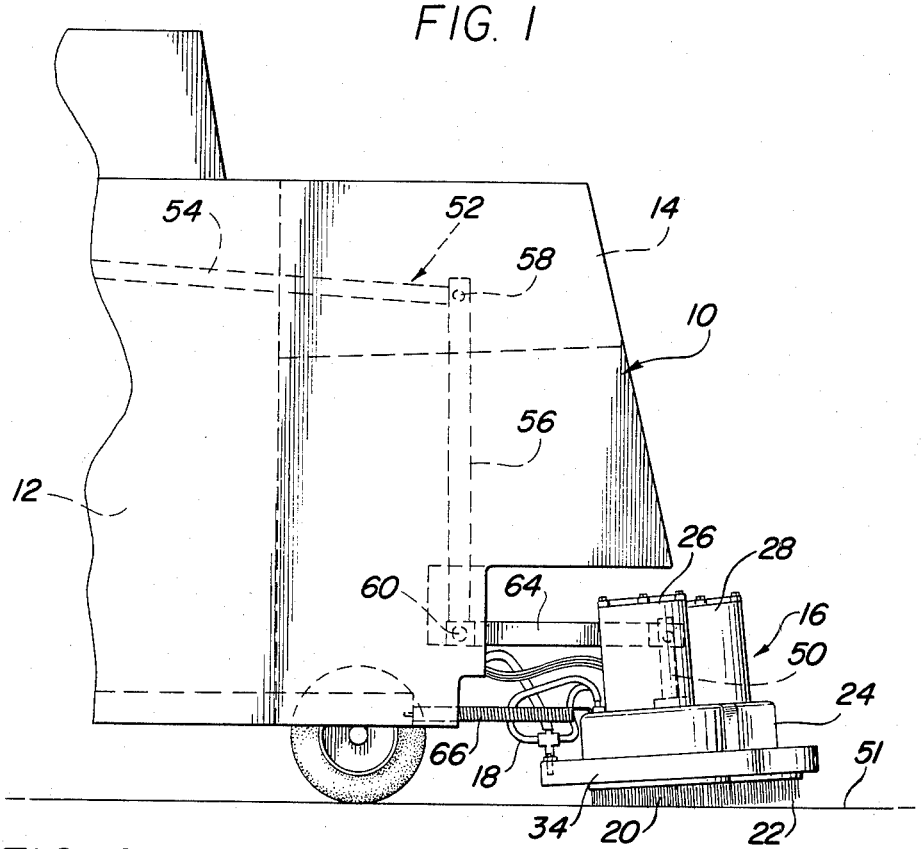
FIG. 1 is a side-elevational view of the front portion of a typical automatic scrubbing machine to which is attached the present invention, a free-floating-brush assembly.
Figure 2:
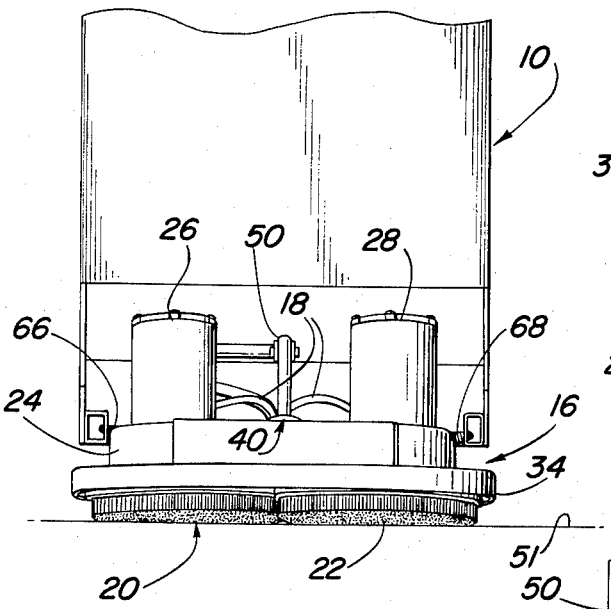
FIG. 2 is a front-elevational view thereof.

Referring more particularly to the drawings, there is shown in FIG. 1 a side-elevational view of the front portion of a typical automatic scrubbing and polishing machine, generally indicated at 10. Such a machine is provided with various drive control means which operate the machine in a forward and reverse direction, as well as operate other attachments such as squeegees, etc. (The rear of the machine is not shown, since it is not part of the invention.) The scrubbing machines are self-contained and battery-operated, and are designed to clean hard-surface floors of narrow cluttered aisles, such as found in supermarkets, department stores, schools, hospitals, etc.

Included within machine 10 is at least one cleaning solution tank 12 and a recovery tank 14. Tank or tanks 12 are connected to the free-floating brush assembly, designated at 17, by means of flexible hoses 18 which spray the cleaning solution on the floor as well as the brushes 20 and 22, according to the manner well known in the art.

The free-floating-brush assembly 16 comprises a housing 24 on which is mounted a pair of motors 26 and 28, preferably motors having permanent magnets. These motors are suitably mounted to the top wall 30 of housing 24 so as to be positioned directly over their respective brushes 20 and 22. Various arrangements can be employed to attach each brush to its motor; but preferably the brushes are directly attached to the motors. Thus, brush 20 is readily allowed to rotate counterclockwise as indicated by arrow 32, and brush 22 is allowed to rotate clockwise as indicated by arrow 33 in FIG. 3.

Figure 3:
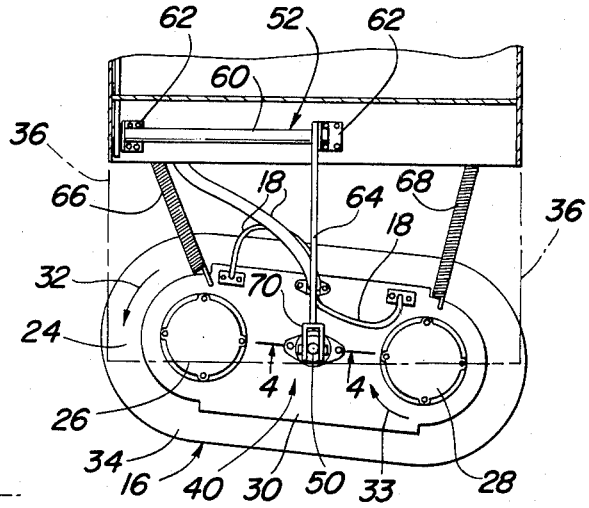
FIG. 3 is a top-plan view of the free-floating-brush assembly.

Housing 24 is formed with a protective skirt 34 which covers the rotating brushes, so as to not only protect the brushes while they are rotating, but to allow the assembly to deflect away from the various objects that might be located in the area to be cleaned. The particular suspension of the housing assembly allows the full assembly to rotate about a central vertical axis, so as not to cause damage to the object or the machine. This movement also allows the machine to traverse along narrow aisles having widths slightly larger than the width of the machine. Thus, the housing 24 can be formed to extend from the outer sides 36 of machine 10, as seen in FIG. 3.

Figure 4:
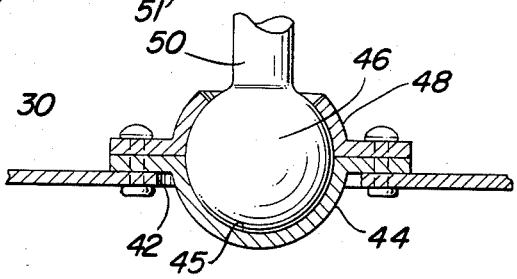
FIG. 4 is an enlarged sectional view taken along line 4—4 of FIG. 3.

In order to provide for the free-floating arrangement of the assembly, there is further included a swivel means, generally indicated at 40. As one example of a swivel means, FIG. 4 illustrates top wall 30 as having an aperture 42 which is centrally positioned therein to receive the bottom section 45 of a ball socket 45, in which ball 46 is mounted by means of an upper socket section 48. Ball 46 is formed having an axis pin 50 which extends generally upward from housing 24. Axis pin 50 is pivotally connected to a joystick-lever system, indicated at 52. Lever system 52 allows the operator of the machine to conveniently control and adjust the position and force of brushes 20 and 22 against the floor surface 51. Accordingly, lever system 52 comprises a lever arm 54 which is suitably mounted so as to extend rearwardly of the machine, whereby arm 54 is hand-operated at one end, and is pivotally connected at its opposite end to a bell crank.

The bell crank is formed having a first crank arm 56 pivotally connected to lever arm 54 at 58. Crank arm 56 projects downwardly and is fixedly secured to crank rod 60 which is rotatably supported in brackets 62. A second crank arm 64 is affixed to crank rod 60 and extends horizontally outward, with its free end pivotally connected to axis pin 50 of ball joint 40. Thus, as lever arm 54 is pushed forwardly, brushes 20 and 22 are forced against floor 51. Hence, brushes 20 and 22 and housing 24 are allowed to freely seek whatever position that might be determined by an uneven floor.

As can be seen, housing 24 is capable of rotating about the vertical axis of pin 50 due to its ball-joint connection. Moreover, housing 24 together with brushes 20 and 22 should be angularly disposed with respect to the scrubbing-machine unit 10, as seen in FIG. 3. As previously mentioned, this arrangement allows the brushes to overlap to prevent streaking. Thus, in order to provide for the angular displacement of housing 24 and yet allow it to rotate about the vertical axis of pin 50, there is included an alignment means that is defined by biasing means comprising at least two spring members 66 and 68. Spring 66 is connected at one end to the machine and extends outwardly therefrom, so as to be connected at its opposite end to housing 24, just behind motor 26. Spring 68 is connected at one end to the machine and extends outwardly therefrom so as to be connected at its opposite end to housing 24, just behind motor 28. Spring 68 is longer than spring 66 thereby angularly displacing the housing. Positioning is effected at the connection between pin 50 and crank arm 64, the crank arm having a yoke end 70 in which the upper end of pin 50 is pivotally secured.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A free-floating-brush assembly adapted for use with conventional floor-scrubbing and polishing machines, wherein the assembly comprises:

means mounted to a floor-scrubbing and polishing machine for adjusting said assembly;

a housing pivotally attached to one end of said adjusting means, so as to be freely suspended in front of said scrubbing and polishing machine;

drive means mounted on said housing;

a pair of brushes mounted in said housing and adapted to engage said floor to be scrubbed and/or polished, said brushes being rotated by said drive means;

means for angularly aligning said housing with respect to said machine and said floor, said means being connected between said machine and said housing;

swivel means centrally mounted to said housing and to said adjusting means, allowing said housing to rotate about a substantially vertical axis, whereby said assembly can adapt to any uneven floor surface.

2. A free-floating-brush assembly as recited in claim 1, wherein said aligning means is defined by a biasing means which causes said housing to be angularly disposed when in a normal suspended mode, and to further cause said housing to return to a given angular position whenever said housing is rotated about said swivel means.

3. A free-floating-brush assembly as recited in claim 2, wherein said biasing means comprises:

a first spring member connected at one end to said machine and at its opposite end to said housing adjacent one of said brushes; and a second spring member connected at one end to said machine and at its opposite end to said housing adjacent said other brush, said second spring being provided with a different length than said first spring, thereby angularly displacing said housing.

4. A free-floating-brush assembly as recited in claim 3, wherein said adjusting means comprises:

a lever arm mounted in said machine, one end of which extends rearwardly therefrom;

a first crank arm pivotally attached to the opposite end of said lever arm;

a crank rod mounted to said machine and fixedly secured to said first crank arm, so as to rotate when said crank arm is moved; and a second crank arm fixedly secured at one end end thereof to said crank rod so as to move with said crank rod, the opposite end of said second crank arm being pivotally attached to said swivel means.

5. A free-floating-brush assembly as recited in claim 4, wherein said swivel means comprises:

a ball-and-socket arrangement attached to said housing; and a central pin fixedly secured to said ball in a substantially vertical position, the free end of said pin being pivotally secured to said second crank arm, whereby said housing is suspended therefrom.

6. A free-floating-brush assembly as recited in claim 5, wherein said drive means comprises a pair of motors, each motor being respectively attached to a brush for direct rotation thereof.

* * * * *